United States Patent [19]

Rule et al.

[11] Patent Number: 5,045,695

[45] Date of Patent: Sep. 3, 1991

[54] TRANSITION RADIATION INTERFERENCE SPECTROMETER

[75] Inventors: Donald W. Rule; Ralph B. Fiorito, both of Silver Spring, Md.

[73] Assignee: The United States of America as represented by the Secretary of the Navy, Washington, D.C.

[21] Appl. No.: 532,765

[22] Filed: Jun. 4, 1990

[51] Int. Cl.[5] ..... H01J 49/44

[52] U.S. Cl. ..... 250/305; 250/336.1; 324/71.3

[58] Field of Search ..... 250/305, 336.1; 324/71.3

[56] References Cited

U.S. PATENT DOCUMENTS

| | | | |
|---|---|---|---|
| 3,612,858 | 10/1971 | DeParry | 250/41.95 R |
| 4,568,833 | 2/1986 | Roelofs | 250/398 |
| 4,714,833 | 12/1987 | Rose et al. | 250/397 |
| 4,766,314 | 8/1988 | Jang | 250/296 |
| 4,823,005 | 4/1989 | Garth | 250/310 |
| 4,823,006 | 4/1989 | Danilator et al. | 250/310 |

OTHER PUBLICATIONS

Wartski et al., Journal of Applied Physics, vol. 46, No. 8, Aug. 1975, pp. 3644–3653.

Mahan et al., Review of Scientific Instruments, vol. 47, No. 1, Jan. 1976, pp. 81–83.

*Primary Examiner*—Jack I. Berman

*Attorney, Agent, or Firm*—John D. Lewis; Kenneth E. Walden

[57] ABSTRACT

A transition radiation interference spectrometer for measuring the energy and divergence of a charged particle beam. Transition radiation is created by placing an interferometer in the path of the charged particle beam. The resulting interference pattern is focused and masked to define an angular element at a fixed angle with respect to the direction of specular reflection. The radiation in the angular element is dispersed into wavelength components. The intensity or amplitude of the wavelength components as a function of wavelength is indicative of the beam's energy and divergence.

14 Claims, 2 Drawing Sheets

TRANSITION RADIATION INTERFERENCE SPECTROMETER

ORIGIN OF THE INVENTION

The invention described herein was made in the performance of official duties by employees of the Department Of the Navy and may be manufactured, used, licensed by or for the Government for any governmental purpose without payment of any royalties thereon.

BACKGROUND OF THE INVENTION

1. Field of the Invention

This invention relates to a transition radiation interference spectrometer and in particular to a transition radiation interference spectrometer for measuring the energy and divergence of a charged particle beam.

2. Description of the Prior Art

In attempting to define the behavior of a charged particle beam, scientists for some time have focused on determining the emittance of the beam. Briefly stated, the emittance is a way of describing the beam quality in terms of its divergence at various points within its cross-section. A detailed discussion of emittance and its use in beam diagnostics can be found in "Emittance and Brightness: Definitions and Measurements", by Lejeune and Aubert in Advances in Electronics and Electron Physics, Supplement 13A, 1980.

It is also known in the prior art that beam emittance can be determined once the charged particle beam's energy, divergence and current density profile have been determined. Older methods of determining these quantities have made use of collimators and screens which are cumbersome, expensive and usually restricted to placement at only one fixed beamline location. The collimators and screens also suffer from electron permeability for high energy beams thereby restricting their usefulness. The phosphor screens used have a slow response time and poor spacial resolution. They are also limited in use to large diameter beams on the order of a few centimeters.

Another prior art method makes use of wire scanners placed at multiple stations along the charged particle beam. However, real-time measurements are not possible since the wires need to be scanned successively to determine the beam profiles at each of the multiple stations. It is also known in the prior art to combine the use of focusing magnets with wire scanners. However, this method suffers from the requirement of multiple station beam profile scans as a function of magnet strength and, as such, is not capable of real-time measurement. Still another method makes use of multiple, non-interactive wall current monitors placed along a beam path. However, use of these monitors requires elaborate mathematical analysis to produce an emittance value since multipole moments of the measured beam profiles must be calculated. In addition, all multi-position devices and measurements are sensitive to beam centroid motion and require detailed knowledge of beam particle trajectories and beam profiles. These devices cannot be used to make time resolved measurements or serve as real-time monitors for either beam profile or beam divergence measurements since they typically require lengthy periods of time (several minutes to hours) for data acquisition. Beam energy is typically determined by using magnetic fields to bend the beam through a trajectory that is a function of beam energy.

SUMMARY OF THE INVENTION

Accordingly, it is an object of the present invention to provide a means for obtaining real-time measurements of the energy and divergence of a charged particle beam.

It is a further object of the present invention to provide a means for determining the energy and divergence of a charged particle beam at any location along the beamline.

Other objects and advantages of this invention will become more apparent hereinafter in the specification and drawings.

In accordance with the invention, a transition radiation interference spectrometer has been designed to determine the energy and divergence of a charged particle beam at any location along the beamline at which a beam waist, or minimum radius, can be produced with a focusing magnetic lens system. A two-foil interferometer is placed in the beamline to create a transition radiation interference pattern which consists of variations in light intensity versus angle of emission. The interference pattern is focused onto a spacial filtering mask that permits only a small angular element of the interference pattern to pass through. This radiation is focused onto the diffraction grating of a spectrometer which disperses it into its wavelength components. The intensity of this radiation at a fixed angle, as a function of wavelength, is an indication of the energy and divergence of the charged particle beam. A current density profile of the beam may also be simultaneously measured from the spacial distribution of the light produced at the two-foil interferometer.

DETAILED DESCRIPTION OF THE INVENTION

Figure 1:
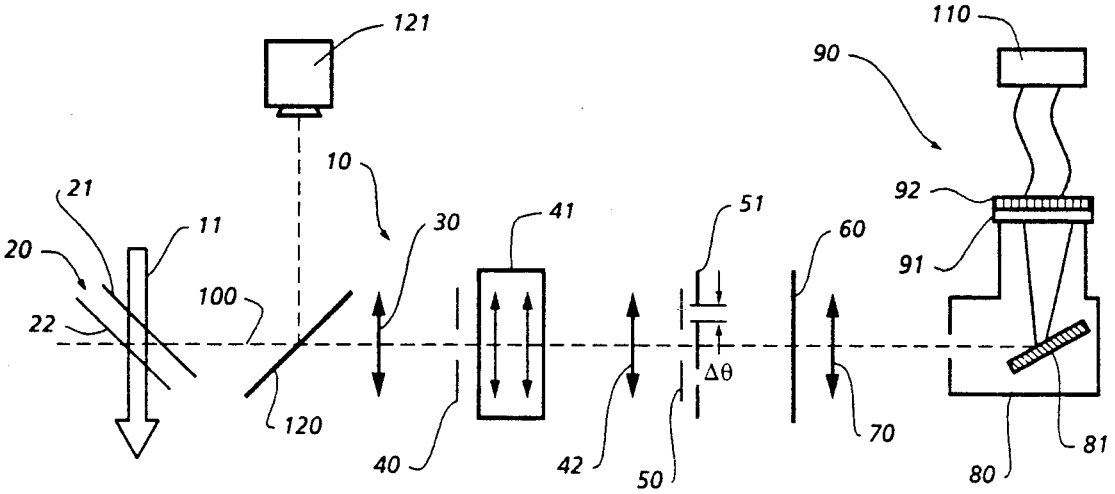
FIG. 1 is a schematic representation of the transition radiation interference spectrometer according to the present invention.

Referring now more particularly to the drawings, FIG. 1 is a schematic representation of the transition radiation interference spectrometer 10 used for determining the energy and divergence of a charged particle beam 11 according to the present invention. For purposes of description only, the invention and its function will be described for radiation produced by the charged particle beam 11 that resides in the visible wavelength spectrum. However, the principles of the present invention apply equally as well to radiation residing in the x-ray, ultra-violet, infra-red and millimeter wavelength spectrums.

A two-foil interferometer 20 is placed in the beam 11 at a location to be analyzed at an angle of 45° with respect to the beam trajectory. Although more than two foils may be used, only the two-foil interferometer 20 will be described for the sake of simplicity. Interferometer 20, having a first foil 21 and a second foil 22, is also provided with a means (not shown) for adjusting the spacing between foils 21 and 22. The component elements of the invention are aligned along an optical axis 100 defined as the direction in which a light ray, travelling parallel to the particle beam 11, would be reflected by foil 22, i.e. the direction of specular reflection. The optical axis 100 is indicated by the horizontal dashed line in FIG. 1.

Interferometer 20 generates an interference pattern produced by optical transition radiation as the beam 11 strikes interferometer 20. The interference pattern is centered about the direction of specular reflection. A lens 30, oriented perpendicular to the specular reflection, focuses the interference pattern at the focal plane 40 of compound microscope 41. Microscope 41 enlarges the interference pattern for an ocular lens 42 which in turn focuses the enlarged interference pattern at the image plane 50 of a spacial filtering mask 51. Mask 51 permits only a small angular element of the interference pattern to pass through. The angular element of the interference pattern is then passed through a rotatable polarizer 60 to separate the angular element into horizontal or vertical components. A focusing lens 70 focuses the horizontal or vertical components onto a spectrometer grating 81 of a spectrometer 80. The diffraction grating 81 disperses the horizontal or vertical components into wavelength components which are then detected and displayed. Typically, detection is accomplished by the use of an image intensifier 91 used in conjunction with an optical multi-channel analyzer array 92 while the display may be accomplished by any conventional display device 110 such as a plotter or cathode ray tube. The resulting display is a plot of intensity of the radiation as a function of wavelength at a fixed angle in the radiation pattern. The intensity as a function of wavelength is indicative of the energy and divergence of the beam 11.

In operation, when the beam 11 strikes interferometer 20, forward transition radiation from the first foil 21 of interferometer 20 and backward transition radiation from the second foil 22 interfere. The device producing the interference of the forward and backward radiation is known in the art as an optical transition radiation (OTR) interferometer. A thorough discussion of two-foil interferometers and OTR is provided by Wartski et al in the *Journal of Applied Physics*, Vol 46, Number 8, August 1975, page 3644, and is incorporated herein by reference. For purposes of the present invention it is sufficient that interferometer 20 produces an OTR interference pattern.

Figure 2:
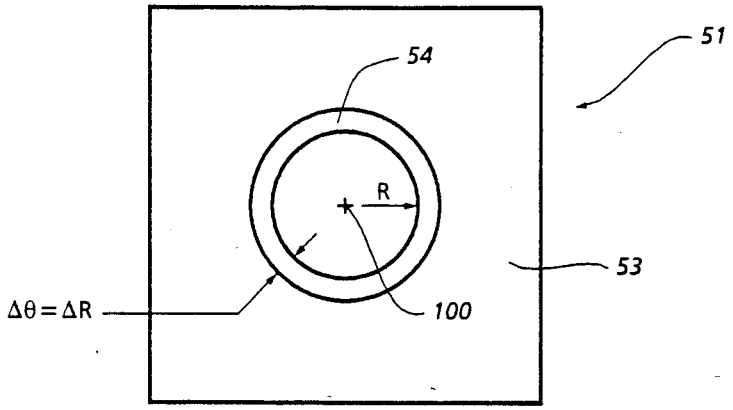
FIG. 2 is a front view of the spacial filtering mask used in the present invention.

In order to determine the energy and divergence of the beam 11, it is necessary to define a small angular element or resolution $\Delta\theta$ of the entire intensity distribution as a function of the angle of emission $\theta$. The angle of emission $\theta$ is measured with respect to the specular reflection or optical axis 100. The angular resolution $\Delta\theta$ to be analyzed is determined by spacial filtering mask 51. Mask 51, shown in a front view in FIG. 2, is an opaque material 53 having a transparent annulus 54 through which the angular element or resolution $\Delta\theta$ may pass through. The radius R of annulus 54 determines the angle of emission $\theta$ with respect to the optical axis 100. The width $\Delta R$ of transparent annulus 54 determines the size of the angular element $\alpha\theta$.

The light passed through mask 51 is polarized into horizontal or vertical components by a rotatable polarizer 60. The horizontal and vertical components can be used to separately measure the components of beam divergence projected into either the horizontal or vertical planes containing the axis of the charged particle beam 11. This is achieved by orienting the polarizer 60 to transmit light polarized alternately in the vertical or horizontal planes.

The horizontal and vertical components are focused by a lens 70 onto a diffraction grating 81. Diffraction grating 81 is used to disperse the light's different wavelength components onto a suitable detector arrangement designated generally by the numeral 90. One suitable arrangement is an image intensifier 91 connected to an optical multi-channel analyzer array 92. The output from the detector arrangement 90 is the OTR intensity for the well-defined angular resolution $\Delta\theta$ at a fixed angle $\theta$ as a function of wavelength.

Figure 3:
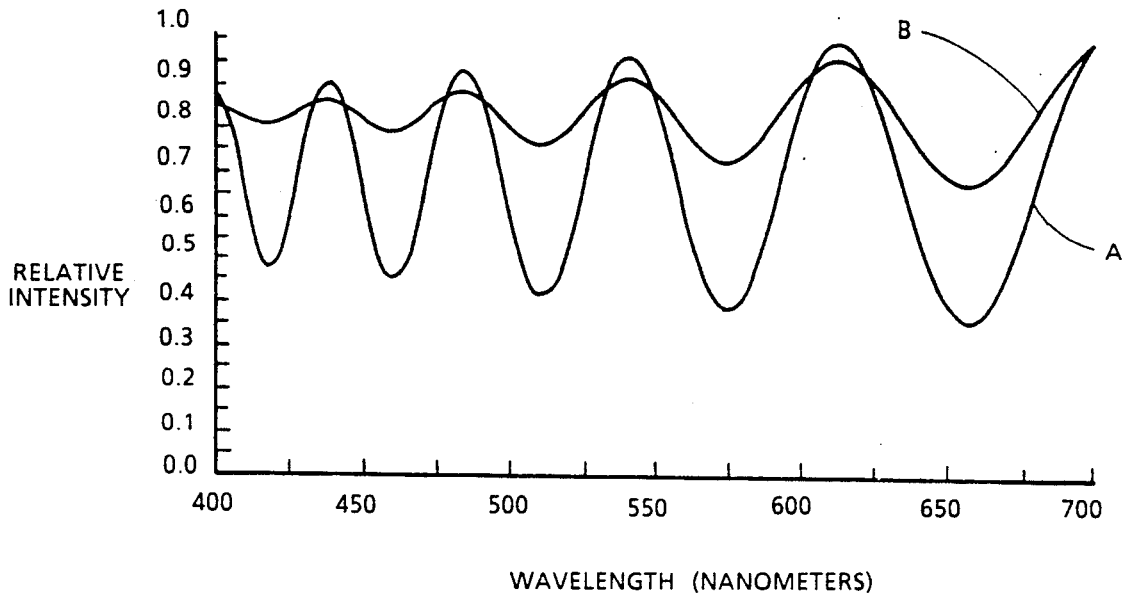
FIG. 3 is a graph of the intensity of the optical transition radiation versus wavelength for two different beam divergences.

As shown in FIG. 3, the observed OTR intensity as a function of wavelength exhibits peaks and valleys. Intensities have been normalized to unity for ease of comparison. Shown are spectra produced by an electron beam 11 having an energy of 185 MeV, a space between foils 21 and 22 of 60 cm and beam divergences of 0.05 milliradians for spectrum A and 0.10 milliradians for spectrum B. Both spectra were produced at an angle of emission equal to 2.75 milliradians with an angular resolution that is much smaller than the beam divergence. Typically, the angular resolution is a chosen to begin the range of 15–10% of the beam divergence.

Figure 4:
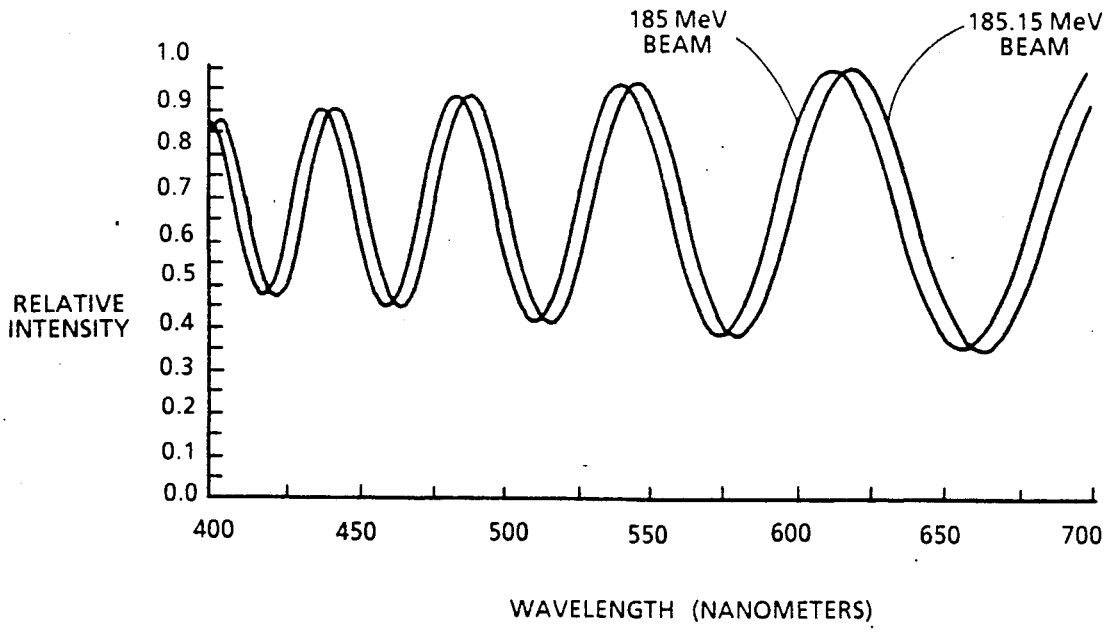
FIG. 4 is a graph of the intensity of the optical transition radiation versus wavelength for two different beam energies.

The spacing of the peaks as a function of wavelength is dependent upon the energy of the charged particle beam 11. FIG. 4 illustrates the effect of a 1% change in beam energy for a 185 MeV beam having 0.05 milliradians beam divergence as in FIG. 3. The change in energy from 185 to 183.15 MeV causes a measurable shift in the wavelength positions of the peaks and valleys. The relative depth of the valleys is determined by the beam divergence. Thus, the energy and beam divergence are determined simultaneously for any location along the beam trajectory. The ranges of energies and divergences that can be measured depend on the beam energy and the spacing between foils 21 and 22. Increasing the foil spacing will produce more fringes for a given energy and therefore, yield a higher sensitivity to beam divergence.

The inherent precision of spectroscopic measurements gives the present invention an important advantage over other techniques, especially when measuring beams with very low divergence. For example, typical spectrometers can resolve differences in wavelength of 0.07 nanometers (nm) for spectra with wavelengths below 1200 nm. At the center of the visible spectrum, this yields a precision of about 1 part in 7100. In contrast, the resolution achieved by the most light sensitive television cameras is typically only 1 part in 200. The spectroscopic precision allows the present invention to measure beam divergences many times smaller than what could be measured by directly imaging the OTR interference pattern as a function of emission angle with a television camera.

The present invention can be further adapted to provide a simultaneous measurement of the beam's current density profile. This is accomplished by measuring the beam distribution by introducing a beamsplitter 120 and camera 121 focused on foil 22 as shown schematically in FIG. 1. The OTR produced at foil 22 and imaged by camera 121 is proportional in intensity to the particle beam current which produced it. This information combined with the beam's energy and divergence can then be used to determine beam emittance by one of the methods known in the prior art.

The present invention can also be used to add data for a specified time period to give a time averaged divergence and energy measurement, or the electronics driving the detector 90 can be gated to record data for a specified time interval in order to record time-resolved beam divergence and energy. The light dispersed by the grating 81 can also be used as an input to a streak camera (not shown) for time-resolved measurements.

The present invention provides the capability of determining time-resolved beam energy and divergence measurements from a single beam pulse. In contrast, prior art devices such as wire scanners require a lengthy procedure of scanning the wire through a beam and can only be useful on an accelerator having repetitively reproducible pulses. Wire scanners also require performing this procedure for at least two different beam positions. For extremely low emittance beams, this requires large separations between the two measurement points and a model to describe the change in the beam as it is transported between the two points.

Another advantage of the present invention is that since it can be used to measure beam energy, divergence and current density at a single position in the beamline, the beam's emittance can be easily determined. In comparison to bending magnets weighing tons and requiring water for cooling and high-power electrical feeds, the present invention is portable and can be used essentially anywhere a line of sight to the beamline is available.

The principles of the present invention can be extended to determining the energy and divergence of a charged particle beam by observing transition radiation produced by the beam that is outside the visible spectrum. For example, beam energy and divergence could be determined by generating x-ray transition radiation at a location in the beamline by using a two or more foil interferometer. Alternatively, the interferometer could be replaced by layers of materials having different dielectric constants or super-lattice materials having periodically alternating dielectric properties. In this case, the transition radiation would be produced nearly parallel to the forward beam direction. Thus, by bending the charged particle beam, one could then detect an angular distribution of the transition radiation with an x-ray spectrometer and x-ray detector system looking into the beam. These components would be analogous to the diffraction grating 81 and detector 90, respectively, described above for the optical device. The mask 51, except for annulus 54, would be opaque with respect to x-rays. Analogous devices operating in the infra-red, ultra-violet and millimeter wave portions of the spectrum could also be constructed with suitable spectrometers and detectors. All of these devices would operate on the same principle described above, i.e. the effects of beam energy and divergence on the spectrum of the transition radiation produced by two or more interfaces.

Thus, although the invention has been described relative to specific embodiments thereof, it is not so limited and numerous variations and modification thereof will be readily apparent to those skilled in the art in light of the above teaching. It is therefore to be understood that within the scope of the appended claims the invention may be practiced otherwise than as specifically described.

What is claimed is:

1. A transition radiation interference spectrometer for determining the energy and divergence of a charged particle beam at a location along the beamline comprising:

means for creating a transition radiation interference pattern at said location;

means for defining an angular element of said interference pattern, said angular element having an angle of emission measured with respect to a specular reflection of said interference pattern; and means for measuring intensity of said angular element as a function of wavelength as an indication of the energy and divergence of the charged particle beam.

2. A transition radiation interference spectrometer as in claim 1 wherein said means for creating said interference pattern comprises an interferometer placed in said beamline at said location at an angle of 45 degrees with respect to said beamline whereby forward and backward transition radiation interfere with each other.

3. A transition radiation interference spectrometer as in claim 2 wherein said interferometer is placed in said beamline at an angle of 45 degrees with respect to the beamline.

4. A transition radiation interference spectrometer as in claim 2 wherein said interferometer comprises a plurality of interfaces.

5. A transition radiation interference spectrometer as in claim 4 wherein said interfaces are parallel to one another.

6. A transition radiation interference spectrometer as in claim 3 wherein said interferometer is a two-foil interferometer.

7. A transition radiation interference spectrometer as in claim 6, said two-foil interferometer having an adjustable foil separation distance.

8. A transition radiation interference spectrometer as in claim 6, said two-foil interferometer producing radiation with wavelengths in the visible spectrum.

9. A transition radiation interference spectrometer as in claim 8 further comprising:

a first lens for focusing said radiation; and a compound microscope for enlarging said focused radiation.

10. A transition radiation interference spectrometer as in claim 1 wherein said defining means comprises a spacial filter mask for permitting only said angular element of said interference pattern to pass through said mask.

11. A transition radiation interference spectrometer as in claim 9 wherein said defining means comprises a spacial filter mask for permitting only said angular element of said interference pattern to pass through said mask.

12. A transition radiation interference spectrometer as in claim 11 wherein said mask comprises an opaque material having a transparent annulus for permitting only said angular element to pass through said mask.

13. A transition radiation interference spectrometer as in claim 12 further comprising:

a polarizer for separating said angular element of said interference pattern passed through said mask into horizontal and vertical components:

a second lens for focusing said horizontal and vertical components; and a diffraction grating for separating said focused horizontal and vertical components into wavelength components.

14. A transition radiation interference spectrometer as in claim 13 wherein said measuring means comprises:

means for detecting the amplitude of said wavelength components; and means for displaying the amplitude of said wavelength components as a function of wavelength.

* * * * *